US007156154B2

(12) United States Patent
Jacobson et al.

(10) Patent No.: US 7,156,154 B2
(45) Date of Patent: Jan. 2, 2007

(54) DEVICE FOR CONTINUOUS OR SEMI-CONTINUOUS CASTING OF METAL MATERIAL

(75) Inventors: Nils Jacobson, Stockholm (SE); Jan Erik Eriksson, Västerås (SE); Erik Svensson, Västerås (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 11/123,124

(22) Filed: May 6, 2005

(65) Prior Publication Data

US 2005/0205235 A1 Sep. 22, 2005

Related U.S. Application Data

(63) Continuation of application No. 10/311,539, filed as application No. PCT/SE01/01187 on May 28, 2001, now abandoned.

(30) Foreign Application Priority Data

Jun. 21, 2000 (SE) ..... 0002333

(51) Int. Cl.
*B22D 11/00* (2006.01)
*B22D 27/02* (2006.01)

(52) U.S. Cl. ..... 164/502; 164/503

(58) Field of Classification Search ..... 164/466–468, 164/502–504

See application file for complete search history.

(56) References Cited

U.S. PATENT DOCUMENTS 4,591,529 A * 5/1986 Behringer et al. ..... 442/183
6,039,818 A * 3/2000 Toge et al. ..... 148/307

FOREIGN PATENT DOCUMENTS

JP 58-74025 * 5/1983
WO WO 97/17151 * 5/1997

* cited by examiner

*Primary Examiner*—Kuang Y. Lin
(74) *Attorney, Agent, or Firm*—Buchanan Ingersoll & Rooney PC

(57) ABSTRACT

The present invention relates to a device for continuous or semi-continuous casting of a metal material. The device comprises a first arrangement comprising a coil (7) having an extension around the casting mould (2) in an area, which is arranged to comprise molten metal material. The coil (7) is arranged to be fed with alternating current such that a varying magnetic field generated and is applied to the molten metal material in the casting mould (2). The device also comprises a second arrangement comprising at least two magnetic poles (8), which are provided at opposite sides of the casting mould (2). The poles (8) are arranged to supply a static or periodic low-frequency magnetic field to the molten metal material in the casting area. The poles (8) comprise at least a portion (11) which comprises a plurality of material layers which are electrically insulated from each other.

12 Claims, 3 Drawing Sheets

DEVICE FOR CONTINUOUS OR SEMI-CONTINUOUS CASTING OF METAL MATERIAL

This application is a continuation of U.S. application Ser. No. 10/311,539, filed Feb. 11, 2003, now abandoned which is a national stage application of PCT International Application No. PCT/SE01/01187 filed 28 May 2001, which claims priority from Swedish Application No. 0002333-3 filed 21 Jun. 2000. U.S. application Ser. No. 10/311,539, PCT International Application No. PCT/SE01/01187, and Swedish Application No. 0002333-3 are hereby incorporated by reference in their entirety.

BACKGROUND OF THE INVENTION AND PRIOR ART

The present invention relates to a device for continuous or semi-continuous casting of a metal material, wherein the device comprises a casting mould which allows casting of a metal material to a desired shape, means for supplying a molten metal material to the casting mould, a first arrangement comprising a coil having an extension around the casting mould in a moulding area arranged to comprise molten metal material and which coil is arranged to be fed with an alternating current in such a way that a varying magnetic field is generated and is applied to the molten metal material in the casting mould and a second arrangement comprising at least two magnetic poles which are provided at opposite sides of the casting mould and which poles are arranged to supply a static or periodic low-frequency magnetic field to the molten metal material in the casting mould.

The metal material used at such a casting process may be a pure metal or an alloy of metals. The casting mould usually used is a cold mould, which is open in both ends in the casting direction. The mould has usually a substantially square or rectangular cross-section. Said means are arranged to allow supply of the melt at an open or closed casting. In connection with a continuous casting process for manufacturing of a usually elongated cast strand, it is known to use an arrangement called electromagnetic casting (EMC). The electromagnetic casting implies that one applies a varying magnetic field to the melt in the casting mould. By the presence of the varying magnetic field in the melt, the melt is subjected to a force action, which is directed towards the interior of the casting mould. The contact pressure between the melt and the wall surface of the casting mould decreases and an increased surface fineness of the finished metal material may thus be obtained. In connection with a continuous casting process, it also is known to use another arrangement, which is called electromagnetic brake (EMBR). Such an electromagnetic brake comprises yokes and poles, which are provided around the casting mould. The yokes and the poles are constructed of a solid magnetic steel. Coils are provided around the poles. The coils are arranged to be fed with direct current such that in the air-gap between the poles a static magnetic field is created which is applied to the molten metal material in the casting mould. Such a static magnetic field brakes the motions of the molten material in the casting mould. Hereby the risk decreases that harmful inclusions arise in the finished cast strand in form of, for example, slag and gases.

However, the existence of the solid poles of the magnetic material of the electromagnetic brake in immediate vicinity of the coil fed with alternating current results in an influence of the magnitude and extension of the varying magnetic field. According to calculations, the flux density of the varying magnetic field may decrease with about 23% in the melt at a presence of such solid poles. Furthermore, the solid poles of the electromagnetic brake become subjected to an inductive heating by the varying magnetic field. Therefore, the poles need to be chilled.

SUMMARY OF THE INVENTION

The object of the present invention is to provide a device for continuous or semi-continuous casting of a metal material which allows the use of an electromagnetic casting as well as an electromagnetic brake, without any of these arrangements influencing negatively the function of the other arrangement.

This object is achieved by the device of the initially mentioned kind, which is characterised in that said poles comprise at least a portion having a plurality of material layers which are electrically insulated from each other. Since the poles comprise at least such a portion, which may be laminated, a considerably less influence on the magnitude and extension of the varying magnetic field by the poles is provided. Furthermore, a lamination of the solid poles results in that they do not in the same manner become subjected to inductive heating by the varying magnetic field. It depends on the so-called eddy current losses being considerably lower in a laminated material than in a solid material. Therefore, no special cooling equipment needs to be used to chill the laminated poles, but cooling by self-convection is usually quite sufficient for preventing that the poles reach a too high temperature.

According to a preferred embodiment of the present invention, said material layers comprise an electric steel. Different kinds of electric steels are possible to use but a siliconized electric steel having a high resistivity is used with advantage. The high resistivity influences on the depth of penetration of the varying magnetic field in a favourable manner. Therefore the material layers do not need to be made too thin. Advantageously, said material layers have a thickness in the range of 0.25–0.5 mm.

According to another preferred embodiment of the present invention, said portion of the pole comprises a part of the pole, which is located nearest the coil of the first arrangement. Generally, the poles are provided on the outside of the coil, which generates the varying magnetic field. That part of the poles, which is located nearest the coil, is subjected to the heaviest varying magnetic field for that reason and consequently ought to be laminated first of all.

The thickness of the laminated layers may be elected with regard to the so-called depth of penetration of the magnetic field in the pole material. The depth of penetration may be calculated with a knowledge of the frequency of the magnetic field and the resistivity and permeability of the pole material. Advantageously, each of said layers comprises a plate shaped element having two substantially plane lateral surfaces which have an extension in a plane substantially perpendicular to the direction of current in the most closely located part of the coil. Thus, such an orientation of the layers is obtained that a minimal field constriction is obtained by the varying magnetic field and the influence on the varying magnetic field by the pole becomes substantially negligible.

According to another preferred embodiment of the present invention, the coil of the first arrangement and at least one of the poles of the second arrangement are provided in contact with each other. Hereby, a compact device is obtained. At the same time, a relatively small air-gap between the end surfaces of the poles provided towards each other is obtained. A small air-gap between the end surfaces of the poles results in that a less supply of electric energy is required for establishing a required static magnetic field acting on the melt in the casting mould. In order to reduce the air-gap further between the end surfaces of the poles directed to each other, one pole may at least comprise a recess which is arranged to receive said coil. Thus, a further compact unit is obtained. Advantageously, the coil and the poles constitute here an integrated part.

According to another preferred embodiment of the present invention, the second arrangement comprises at each of said opposite sides at least one pole, which poles have an extension along substantially the whole width of the casting mould and a yoke which connects said poles to each other.

With such an arrangement at least one static or periodic low-frequency magnetic field is obtained, which covers the whole width of the casting mould. According to an alternative embodiment, the second arrangement may comprise at each of said opposite sides at least two poles and yokes connecting the poles, located at the same side of the casting mould, to each other. Hereby, at least two local static or periodic low-frequency magnetic fields are obtained, which may be located at suitable places along the width of the casting mould. According to a further alternative embodiment of the second arrangement, said two poles, which are provided at the same side of the casting mould, may have an extension along substantially the whole width of the casting mould and be provided at different levels in relation to the casting mould. Hereby, two parallel static or periodic low-frequency magnetic fields are provided which each covers the whole width of the casting mould. The supply of the molten material ought in this case to be done at a level between the two magnetic fields.

According to another preferred embodiment of the present invention, the second arrangement comprises coils extending around each of said poles, which are arranged to be fed with a direct current or a low-frequency alternating current. Thus, magnetic poles will be created which generate a static or a periodic low-frequency magnetic field of a suitable magnitude such an effective braking of the motions of the melt in the casting mould is obtained. Advantageously, said means comprises a tubular shaped member, which supplies the molten metal material at a suitable place in the casting mould. Alternatively, said means may comprise a shank by which the molten metal material is poured down into the casting mould. Advantageously, the cast metal material comprises steel, which is a material, which successfully may be moulded continuously by the device according to the invention.

BRIEF DESCRIPTION OF THE DRAWINGS

In the following, preferred embodiments of the invention are described as examples with reference to the attached drawings, in which.

DETAILED DESCRIPTION OF PREFERRED EMBODIMENTS OF THE PRESENT INVENTION

Figure 1:
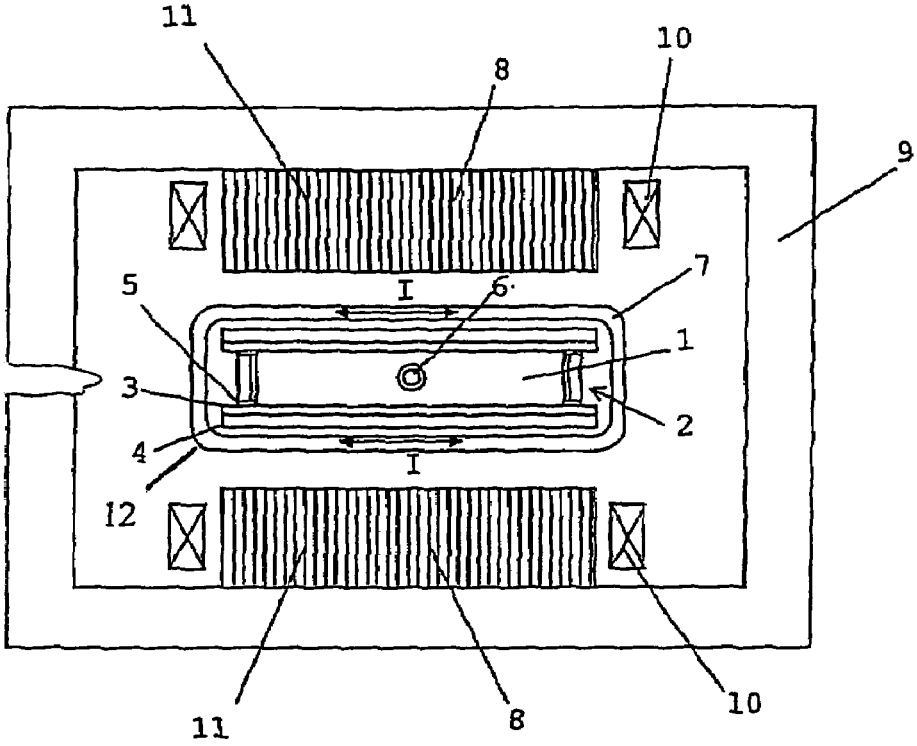
FIG. 1 shows a cross-section from above of a first embodiment of a device according to the present invention.
Figure 2:
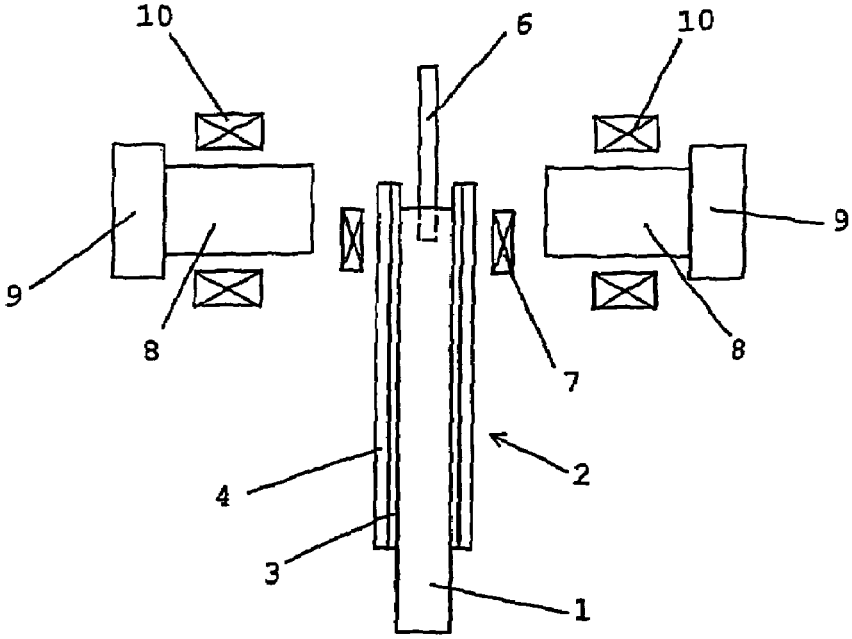
FIG. 2 shows the device in FIG. 1 seen in a sectional view from the side.

FIGS. 1 and 2 show a device, which is intended for a continuous or semi-continuous casting process of an elongated cast strand 1. The cast strand 1 is a metal material, which, for example, is steel. The device comprises a casting mould in form of a mould 2. The mould 2 discloses a casting space which has an upper opening at which a molten metal material is arranged to be supplied and a lower opening at which the solidified metal material is arranged to be fed out continuously as a cast strand 1. The casting space of the mould 2 is delimited by two long sidewalls and two short sidewalls. Each of the long and the short sidewalls comprises an internal plate 3 and an external support plate 4. The internal plate 3 consists usually of copper or a copper-based alloy. The internal plate 3 discloses thus good heat-conducting and electricity-conducting properties. Advantageously, the external support plate 4 is manufactured of steel beams. At least one of the plates 3, 4 comprise internal channels for a circulating cooling medium, which, for example, is water. However, the cooling channels are not shown in the figures. Insulating materials 5 are applied in all joints between the long sidewalls and the short sidewalls of the mould 2. The device comprises a tubular shaped member 6, which is arranged to guide the molten metal material through the upper opening of the mould 2 to the casting space in the mould 2. The tubular shaped member 6 comprises at a lower end two radial openings provided in such a way that the molten metal material obtains a principal movement direction outwards from the tubular shaped member 6 towards the short sidewalls of the mould 2.

The device comprises a first arrangement for allowing a so-called electromagnetic casting (EMC) of the metal material in the mould 2. The first arrangement comprises a coil 7 having an extension around the mould 2 at an area, which contains molten metal material. By feeding the coil 7, which extends around the mould 2, with alternating current, a varying magnetic field is generated around the coil 7. Advantageously, alternating current in the frequency range of 50–1000 Hz is supplied. The hereby varying magnetic field generated around the coil 7 is applied to the molten metal material in the mould 2. The applied varying magnetic field provides a force action on the melt which is directed towards the interior of the mould 2 such that the pressure between the melt and the internal contact surface of the mould 2 decreases. The low contact pressure between the melt and the wall surface of the mould 2 has a positive influence on the surface fineness of the cast strand.

The device comprises also a second arrangement, which allows a so-called electromagnetic breaking (EMBR) of the motions of the molten metal material in the mould 2. The second arrangement comprises two magnetic poles 8, which are provided at opposite sides of the mould at an area, which is arranged to comprise molten metal material. The poles 8 are provided on the outside of the coil 7 and have an extension along substantially the whole width of the mould 2. A yoke 9 having an extension around the mould 2 connects the poles 8 to each other. A coil 10 is provided around each of the poles 8. The coil 10 is arranged to be fed with direct current or a low-frequency alternating current such a static or periodic low-frequency magnetic field is created between the poles 8. The poles 8 consist in this case of just one laminated portion 11 comprising a plurality of thin sheet elements having a rectangular shape. The sheet elements are provided in rows such the even lateral surfaces of the sheet elements are in contact with lateral surfaces of other adjacent sheet elements. The sheet elements are electrically insulated from each other. The lateral surfaces of the sheet element have an extension in a plane, which is perpendicular to the direction of current in the most closely located part of the coil 7 around which the varying magnetic field is generated. Advantageously, the sheet elements comprise a siliconized electric steel with a high resistivity.

When the coils 10 are fed with direct current or a low-frequency alternating current, a static or periodic low-frequency magnetic field is created in the air-gap between the end surfaces of the poles 8, which are directed against each other. By the elongated design of the poles 8 along the long sides of the mould, a static or low frequency magnetic field here applies along the whole width of the mould 2. Such a magnetic field brakes the motions of the melt such a more uniform velocity distribution is obtained in the whole melt in the casting space of the mould 2. Thus, the risk decreases that inclusions are formed during the solidifying process of the melt in the mould 2.

However, the varying magnetic field, which is applied to the melt by the coil 7, is considerably reduced in magnitude and extension if a conventional electromagnetic brake with solid poles is provided in the immediate vicinity of the coil 7. According to performed theoretic calculations, the flux density of the varying magnetic field may be reduced by about 23% at presence of such a solid pole. Furthermore, the solid poles of the electromagnetic brake become subjected to an inductive heating by the varying magnetic field. Therefore, the poles need to be actively chilled. By the present device, this problem is solved in that the poles 8 comprise at least one laminated portion 11, i.e. a portion, which consists of a plurality of sheet elements, provided car by car in a row and which are electrically insulated from each other. Advantageously, the sheet elements have a thickness in size of 0.25–0.5 mm. Very small eddy current circuits arise in sheet elements having such a thickness, when the sheet elements are subjected to a varying magnetic field. By that fact, laminated poles 8 will not be heated as much as solid poles when they are subjected to a varying magnetic field. For laminated poles 8, a cooling by self-convection often is quite sufficient for the poles not to obtain a too high temperature. Furthermore, the same field constriction does not arise in a laminated pole as in a solid pole, when it is subjected to a varying magnetic field. Thus, the varying magnetic field, which is generated by the coil 7, is only insignificantly influenced by the presence of a laminated pole 8. However, the poles 8 ought to be laminated such the lateral surfaces of the sheet elements have an extension, which is substantially parallel with the spreading direction of the varying magnetic field from the coil 7, i.e. the lateral surfaces ought to be provided perpendicular to the direction of current I in the most closely located part of the coil 7.

Figure 3:
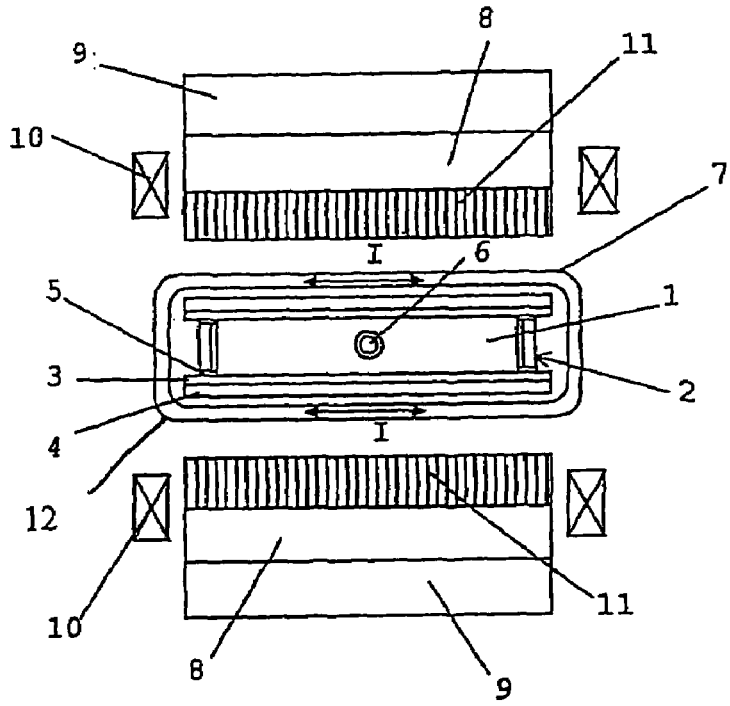
FIG. 3 shows a cross-section from above of a second embodiment of the present invention.
Figure 4:
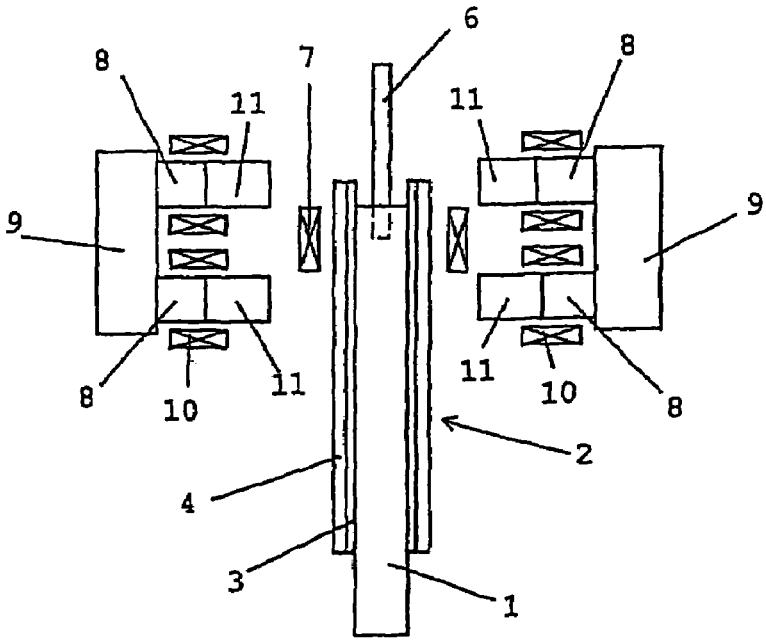
FIG. 4 shows the device in FIG. 3 seen in a sectional view from the side.

FIGS. 3 and 4 show a second embodiment of the invention. In this case, the laminated portion 11 constitutes only a part of the pole 8. The laminated portion 11 is the part of the pole 8, which is, located nearest the coil 7 and consequently, the part of the pole 8 which is subjected to the heaviest varying magnetic field. In many cases, it is quite sufficient to laminate only such a portion 11 of the poles 8. The second arrangement comprises here four poles 8. Two poles 8 are provided at each side of the mould 2. A yoke 9 connects the two poles 8, which are provided at the same side of the mould 2 to each other. The poles 8 provided at the same side is located at different levels in relation to the mould 2 and have each an extension along substantially the whole width of the mould 2. The coils 10 are provided around each of the poles 8. By feeding the coils 10 with a direct current or a low-frequency alternating current, two parallel static or periodic low-frequency magnetic field at different levels are in this case generated in the mould 2. The magnetic fields are arranged to extend through the area in the mould 2, which comprises molten metal material. The supply of the molten metal material to the mould 2 performs here with advantage at a level between the two parallel magnetic fields.

Figure 5:
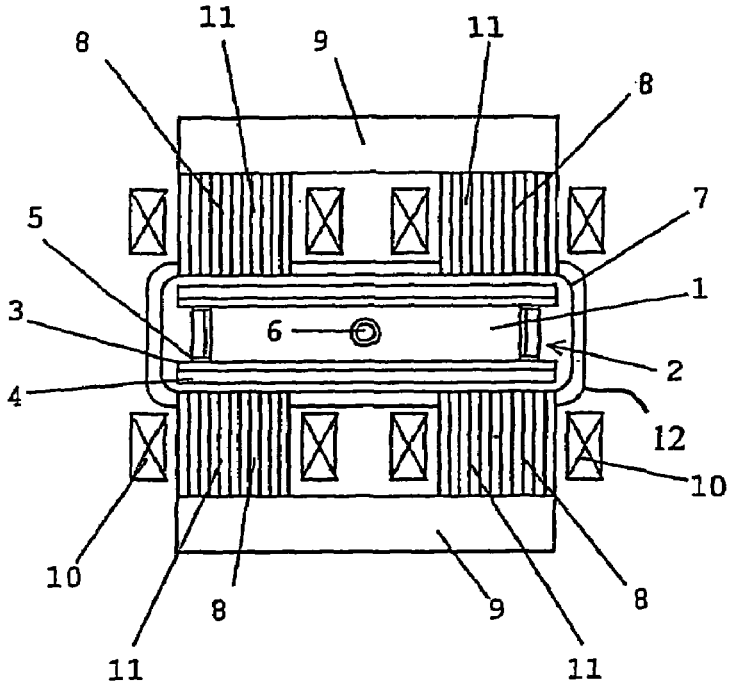
FIG. 5 shows a cross-section from above of a third embodiment of the present invention and FIG. 6 shows the device in FIG. 5 seen in a sectional view from the side.
Figure 6:
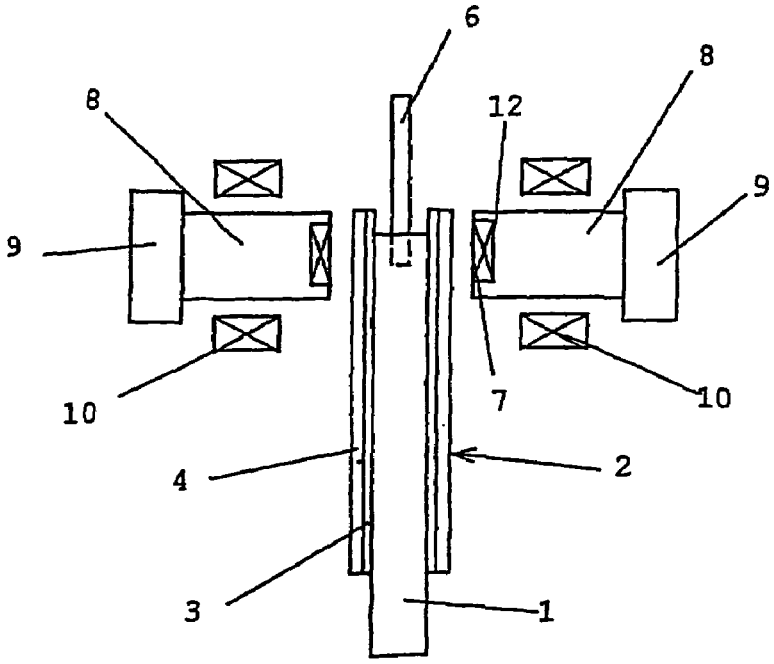

FIG. 5 and 6 show a third embodiment of the invention. In this case the whole poles 8 comprises a laminated portion 11. The poles 8 are provided with recesses 12, which are arranged to receive the coil 7. Here, the poles 8 and the coil 7 consist of an integrated part. Thus, the device becomes compact and requires thereby a relatively small space. Furthermore, a smaller air-gap between the end surfaces of the poles 8 is obtained than in the above-described embodiments. By that fact, just as much electric energy does not need to be supplied to the coils 10 for providing a required magnetic field in the air-gap for the casting process. The second arrangement comprises here four poles 8. Two poles 8 are provided at each side of the mould 2. A yoke 9 connects the two poles 8, which are provided at the same side of the mould to each other. The two poles 8, which are provided at the same side, are located at the same level and have an extension along a part of the width of the mould 2. Coils 10 are provided around each of the poles 8. By feeding the coils 10 with a direct current or a low-frequency alternating current, two parallel static or periodic low-frequency magnetic fields are in this case generated, which are located at the same level in relation to the mould 2.

The present invention is not in any way restricted to the above-described embodiments in the drawings but may be modified freely within the scopes of the claims. For example, the different types of electromagnetic brakes, shown in the drawings, may be combined freely with the shown alternative laminated embodiments of the poles.

The invention claimed is:

1. A device for continuous or semi-continuous casting of a metal material, wherein the device comprises:

a casting mould which allows casting of a metal material to a desired shape, means for supplying a molten metal material to the casting mould;

a first arrangement comprising a coil having an extension around the casting mould in a moulding area arranged to comprise molten metal material and which coil is arranged to be fed with an alternating current in such a way that a varying magnetic field is generated and is applied to the molten metal material in the casting mould; and a second arrangement comprising at least two magnetic poles which are provided at opposite sides of the casting mould and which poles are arranged to supply a static or periodic low-frequency magnetic field to the molten metal material in the moulding areas, wherein said poles comprise at least a portion which comprises a plurality of material layers which are electrically insulated from each other, wherein each of said material layers comprises plate shaped elements having two substantially plane lateral surfaces which have an extension in a plane substantially perpendicular to the direction of the current (I) in the most closely located part of the coil;

wherein the coil of the first arrangement and at least one of the poles of the second arrangement are provided in contact with each other.

2. A device according to claim 1, wherein said material layers comprise an electric steel.

3. A device according to claim 2, wherein said material layers comprise a siliconized electric steel having a high resistivity.

4. A device according to claim 1, wherein said material layers have a thickness in the range of 0.25–0.5 mm.

5. A device according to claim 1, wherein said portion of the pole comprises a part of the pole which is located nearest the coil of the first arrangement.

6. A device according to claim 1, wherein at least one pole comprises a recess arranged to receive said coil.

7. A device according to claim 1, wherein the second arrangement comprises at each of said opposite sides at least one pole, which poles have an extension along substantially the whole width of the casting mould and a yoke which connects said poles to each other.

8. A device according to claim 1, wherein the second arrangement comprises at each of said opposite sides at least two poles and yokes connecting the poles, which are located at the same side of the casting mould, to each other.

9. A device according to claim 8, wherein said poles which are provided at the same side of the casting mould have an extension along substantially the whole width of the casting mould and are provided at different levels in relation to the casting mould.

10. A device according to claim 1, wherein the second arrangement comprises coils extending around each of said poles which are arranged to be fed with a direct current or a low-frequency alternating current.

11. A device according to claim 1, wherein said means for supplying the molten metal material comprises a tubular member which supplies the molten metal material into the casting mould.

12. A device according claim 1, wherein the cast metal material comprises steel.

* * * * *